United States Patent [19]

Schetzsle et al.

[11] Patent Number: 4,720,018

[45] Date of Patent: Jan. 19, 1988

[54] SCORING ARRANGEMENT FOR A TAMPER-INDICATING PLASTIC CLOSURE

[75] Inventors: John Schetzsle; Michael E. Corcoran, both of Crawfordsville, Ind.

[73] Assignee: H-C Industries, Inc., Crawfordsville, Ind.

[21] Appl. No.: 907,970

[22] Filed: Sep. 16, 1986

Related U.S. Application Data

[63] Continuation-in-part of Ser. No. 824,428, Jan. 31, 1986, Pat. No. 4,666,053.

[51] Int. Cl.[4] ..... B65D 41/34

[52] U.S. Cl. ..... 215/252

[58] Field of Search ..... 215/252, 256

[56] References Cited

U.S. PATENT DOCUMENTS 3,812,991 5/1974 Wurl ..... 215/252
4,545,496 10/1985 Wilde et al. ..... 215/252
4,565,295 1/1986 Mori et al. ..... 215/252

FOREIGN PATENT DOCUMENTS 2309499 9/1974 Fed. Rep. of Germany ..... 215/252

*Primary Examiner*—Donald F. Norton
*Attorney, Agent, or Firm*—Dressler, Goldsmith, Shore, Sutker & Milnamow, Ltd.

[57] ABSTRACT

A tamper-indicating plastic closure construction is disclosed which includes an annular pilfer band which depends from an annular skirt portion of the closure. The pilfer band is partially detachably connected to the skirt portion by frangible ribs, and remains connected to the skirt portion attendant to removal of the closure from a container. To facilitate such removal, the pilfer band includes a fracturable portion defined by a pair of vertically spaced, vertical scores. In order to substantially prevent any propagation of the upper one of the vertical scores, another score is formed in intersecting relation thereto. Consistent manufacture and reliable performance are further promoted by the formation of a stabilizing score in operative association with the fracturable portion of the pilfer band.

4 Claims, 3 Drawing Figures

SCORING ARRANGEMENT FOR A TAMPER-INDICATING PLASTIC CLOSURE

CROSS-REFERENCE TO RELATED APPLICATION

The present application is a continuation-in-part of U.S. application Ser. No. 824,428, filed Jan. 31, 1986, U.S. Pat. No. 4,666,053.

TECHNICAL FIELD

The present invention relates generally to a tamper-indicating plastic closure construction for bottles and like containers, and more particularly to a closure construction including a pilfer band and a scoring arrangement therefor whereby the pilfer band fractures and remains connected to a skirt portion of the closure as the closure is removed from a container.

BACKGROUND OF THE INVENTION

Commonly assigned U.S. Pat. Nos. 4,418,828 and 4,497,765 disclose a tamper-indicating plastic closure construction which has proven to be highly commercially successful in light of the efficiency with which it can be formed, and the consistent and reliable tamper-indicating characteristics which it exhibits. The latter of the above patents discloses a method of making the closure with highly desirable efficiency and consistency.

In particular, the construction includes an annular pilfer band which depends from a skirt portion of a plastic closure cap. The pilfer band includes a plurality of circumferentially spaced, inwardly extending flexible projections which are configured to coact and cooperate with an annular locking ring portion of an associated container. The pilfer band is generally distinguished from the closure skirt portion by a horizontal, circumferentially extending score, and is at least partially detachably connected to the skirt portion by frangible means preferably comprising a plurality of circumferentially spaced frangible ribs. Attendant to removal of the closure from a container, the flexible projections coact with the locking ring to fracture the frangible ribs, thereby providing plainly visibly discernable evidence that the closure has been partially or completely removed.

In one embodiment of the above-described closure, a connector portion is provided between spaced apart ends of the horizontal score formed between the pilfer band and skirt portion. The connector portion integrally connects the pilfer band to the skirt portion after fracture of the frangible ribs, whereby the pilfer band remains connected to the closure cap after removal from the container.

In this arrangement, the pilfer band is preferably provided with at least one fracturable area which fractures attendant to closure removal. This fracturable area can comprise one or more scores or cuts formed in the pilfer band generally adjacent to the connector portion which joins the band to the skirt. After removal from the container, the fractured pilfer band typically takes on a curl-like configuration; as a consequence, this type of closure is sometimes referred to as having a pilfer band which forms a "pigtail".

In order to promote convenient removal of closures of the above type from containers, it is desirable that the pilfer band be configured to fracture without undue application of force thereto. On balance, it is important that premature failure of the pilfer band be avoided so that it reliably indicates closure removal.

As noted, one or more scores can be formed in the closure pilfer band in order to form a fracturable area. More specifically, a vertically extending score can be formed so that a non-scored, residual portion of the pilfer band is defined, which said residual portion fails and fractures attendant to closure removal. While it would appear that a readily fracturable construction can be formed by merely scoring the closure pilfer band to define a sufficiently small residual portion, experience has shown that formation of a residual portion which is sufficiently small as to be easily fractured during closure removal is frequently prone to premature failure during formation of the residual portion itself. In this regard, it has been determined that the cutting edge or edges of the one or more blades employed for forming the fracturable residual portion exert a wedge-like action on the pilfer band during scoring which can result in failure of the residual portion as it is formed. Naturally, this is undesirable since the pilfer band must be intact for use as intended.

Further, experience has shown that in some instances, the one or more vertical scores formed in the pilfer band can undesirably propagate, and result in formation of a crack in the plastic material of the closure. Such score propagation can particularly be a problem, attendant to high-speed manufacture, when the pilfer band is scored to provide its fracturable area before the closure is scored horizontally to distinguish the pilfer band and skirt portion.

In order to abate propagation of the vertical score(s), efforts have been made to first score the closure horizontally, and thereafter effect vertical scoring. However, such efforts have met with limited success, since the vertical scoring can undesirably fracture one or more of the frangible bridges which are formed attendant to the horizontal scoring.

Accordingly, it is desirable to provide a closure pilfer band construction which avoids premature band failure, and which avoids crack formation or the like, while promoting formation of a closure which can be easily and conveniently removed by consumers.

SUMMARY OF THE INVENTION

In accordance with the present invention, a tamper-indicating closure construction is disclosed which has been specifically configured for convenient removal from a container by consumers, while at the same time being subject to efficient, high-speed formation. Briefly summarizing, the present closure construction includes a scoring arrangement for a closure pilfer band which provides a fracturable residual portion in the band between a pair of vertically spaced, upper and lower vertical scores. Notably, a preferably horizontal score is simultaneously formed to substantially intersect the uppermost extent of the upper vertical score, and thereby substantially prevent any propagation thereof. Additionally, an operatively associated stabilizing score is formed in circumferentially spaced relation to the residual portion, which said stabilizing score is generally vertically aligned with and spans the residual portion. This stabilizing score is formed generally simultaneously with formation of the residual portion, and desirably acts to avoid premature failure of the residual portion during its formation by scoring of the pilfer band.

The tamper-indicating closure embodying the present invention comprises a plastic closure cap having a top wall portion, and an annular skirt portion which depends from the top wall portion. In the preferred form, the skirt portion is provided with an internal thread formation configured to coact with a like thread formation provided on a container to which the closure is applied.

The present closure further includes an annular pilfer band which depends from the skirt portion of the plastic closure cap, and which is distinguished from the skirt portion by a circumferentially extending horizontal score formed between the skirt portion and the pilfer band. This circumferential score is preferably arranged to extend partially into a plurality of circumferentially spaced frangible ribs which extend between the inner surfaces of the pilfer band and the skirt portion. In this manner, a detachable connection is formed between the skirt portion and the pilfer band.

In order for the pilfer band to remain attached to the closure cap as the closure is removed from a container, the circumferential score is preferably discontinuous, and does not extend entirely about the closure. A connector portion is thus defined generally between the ends of the circumferential score, with the connector portion integrally connecting the pilfer band to the closure skirt portion. Thus, the pilfer band is partially detachably connected to the skirt portion in the sense that the principal portion of the pilfer band separates from the skirt portion during closure removal, but the band remains joined to the skirt portion by the connector portion.

In order to promote convenient removal of the pilfer band with the closure cap from the container, the pilfer band includes a fracturable portion. In the preferred form, the fracturable portion comprises a residual portion which is defined by score means which extend vertically of the closure in a direction transversely of the pilfer band. The score means preferably comprises a pair of vertically spaced upper and lower scores between which the fracturable residual portion is defined.

In accordance with the present invention, any propagation of the upper vertical score in the pilfer band is substantially prevented by the formation of a preferably horizontal intersecting score. The intersecting score is preferably formed simultaneously with the formation of the vertical scores to substantially intersect the upper vertical score, thereby abating propagation thereof. In the illustrated embodiment, the upper vertical score and the intersecting score together define a generally inverted L-shaped score in the pilfer band.

In the illustrated embodiment, the pilfer band further includes a stabilizing score operatively associated with the fracturable residual portion. The stabilizing score is positioned in closely circumferentially spaced relation to the residual portion, and is preferably formed to be generally vertically aligned with and span the residual portion. The stabilizing score is preferably formed in the pilfer band substantially simultaneously with the vertically spaced scores which define the residual portion. Significantly, this substantially simultaneous formation of the stabilizing score acts to avoid premature failure of the residual portion as it is formed by the wedge-like action of the scoring blades.

Numerous other advantages and features of the present invention will become readily apparent from the following detailed description, accompanying drawings, and the appended claims.

DETAILED DESCRIPTION

Figure 1:
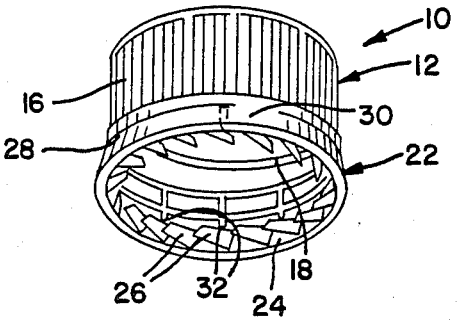
FIG. 1 is a perspective view of a tamper-indicating plastic closure embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Figure 2:
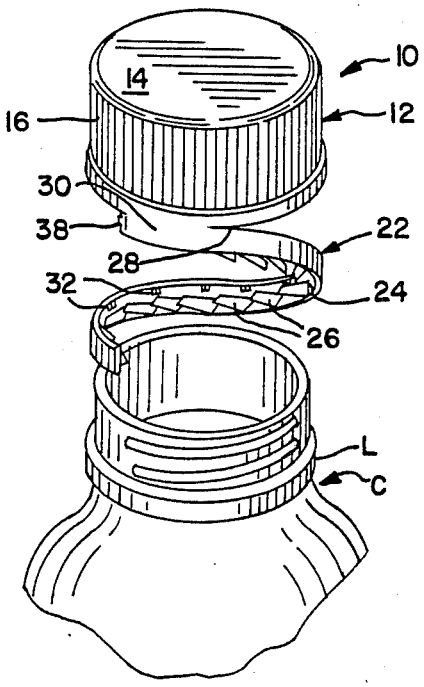
FIG. 2 is a perspective view illustrating the plastic closure of FIG. 1 after it has been removed from an associated container, wherein a pilfer band of the closure has formed a curl-like "pigtail"

Referring first to FIGS. 1 and 2, therein is illustrated a plastic closure 10 embodying the principles of the present invention. Closure 10 can be very efficiently formed in accordance with the teachings of commonly-assigned U.S. Pat. Nos. 4,343,754 and 4,497,765.

Closure 10 includes a cup-like plastic closure cap 12 comprising a top wall portion 14 and an annular skirt portion 16 which depends integrally from the top wall portion 14. The skirt portion 16 is preferably provided with an integral internal thread formation 18 (FIG. 1) which is adapted to mate with a like thread formation on a bottom or like container C to which the closure is applied. The exterior of the skirt portion 16 is preferably provided with axially extending finger grips to promote convenient use by consumers.

Closure 10 desirably includes an annular pilfer band 22 which is arranged to coact with an annular locking ring L on container C during closure removal to provide readily visually discernable evidence that the closure has been removed from the container. Closure 10 is illustrated as including a pilfer band configured in accordance with commonly-assigned U.S. Pat. No. 4,418,828. In this regard, the pilfer band 22 includes an annular band portion 24, and a plurality of circumferentially spaced, relatively flexible wing-like projections 26 which extend integrally inwardly from the band portion 24. Projections 26 are configured to engage and coact with locking ring L on container C attendant to removal of closure 10 therefrom in order to partially detach pilfer band 22 from skirt portion 16.

The partial detachable connection between pilfer band 22 and skirt portion 16 is provided by a circumferential horizontal score 28 formed between and distinguishing pilfer band 22 from skirt portion 16. In a closure of the present type wherein pilfer band 22 is intended to remain partially connected to closure cap 12 after closure removal, circumferential score 28 is discontinuous in the sense that it does not extend completely about closure 10. Rather, score 28 extends substantially completely about closure 10, with an unscored portion of the closure between the ends of the score 28 providing a connector portion 30 which integrally connects pilfer band 22 to the skirt portion 16.

The pilfer band is otherwise detachably connected to the skirt portion by a plurality of circumferentially spaced frangible ribs 32 which extend vertically between the inside surfaces of band portion 24 and skirt portion 16. Circumferential score 28 preferably extends inwardly into the ribs 32 whereby the ribs are frangible, and fracture attendant to closure removal for tamper-indication (note that the portions of fractured ribs 32 provided on pilfer band 22 are visible in FIG. 2 which illustrates the closure 10 after removal, with the pilfer band 22 partially detached from skirt portion 16).

In order to promote convenient removal of closure 10 from container C, including the partial detachment of pilfer band 22 from skirt portion 16, pilfer band 22 is preferably formed with a fracturable portion which fails or fractures as the closure is removed from the container. In accordance with the present invention, pilfer band 22 is provided with fracturable means comprising the provision of a pair of vertically spaced, vertically extending scores 36 between which is defined a non-scored, fracturable residual portion 38 (see FIG. 3). Residual portion 38 is preferably formed in the pilfer band 22 to be generally circumferentially adjacent to connector portion 30, whereby upon failure of portion 38 during closure removal, pilfer band 22 assumes a curl-like, "pigtail" configuration, as illustrated in FIG. 2.

It is presently preferred that a further non-scored, fracturable residual portion be formed between the upper one of scores 36 and the circumferential score 28. This further residual portion (shown in FIG. 3, but unnumbered) desirably acts to stabilize the pilfer band 22, and prevent the pilfer band from twisting or turning about the residual portion 38. In other words, this further unscored portion prevents the portion of band 22 to the left of scores 36 (referring to the orientation of FIG. 3) from twisting about residual 38 such that the upper edge of this band portion moves outwardly while the lower edge moves inwardly.

Figure 3:
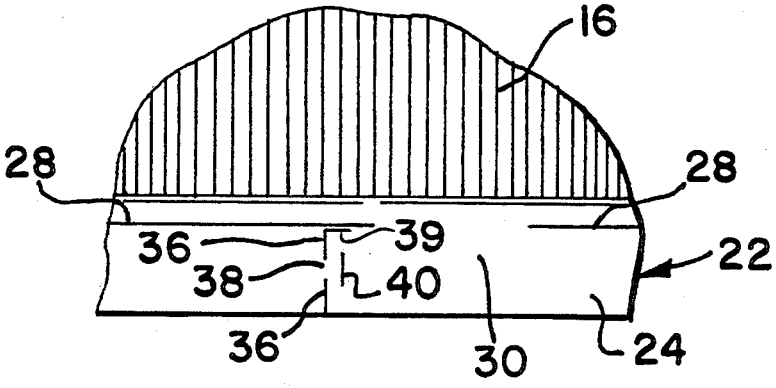
FIG. 3 is a relatively enlarged, fragmentary side elevational view illustrating a scoring arrangement for the closure pilfer band whereby the pilfer band is fracturable.

In accordance with the present invention, and as shown in FIG. 3, pilfer band 22 is further provided with another score in operative association with vertical scores 36, namely an intersecting score 39. Score 39 is arranged to substantially intersect upper vertical score 36, with the score 39 preferably spaced just below horizontal score 28 by a distance corresponding to that which upper score 36 is spaced below score 28.

In the preferred form, intersecting score 39 is horizontal, and thus is perpendicular to upper vertical score 36. In the illustrated embodiment, score 39 has been arranged such that one of its ends intersects the upper end of upper score 36, whereby the scores together define a generally inverted L-shaped score. It is within the scope of the present invention to provide score 39 such that it otherwise intersects upper vertical score 36; for example, the scores can be formed to together define a generally T-shaped score, or score 39 can intersect the upper vertical score 36 other than perpendicularly.

Score 39 is preferably formed substantially simultaneously with formation of upper and lower vertical scores 36. In this manner, the score 39 substantially prevents any propagation of the upper score 36 upwardly of the pilfer band toward skirt portion 16 of the closure cap. This is particularly desirable since the vertical scores 36 are preferably formed prior to formation of circumferential score 28.

Thus, the provision of intersecting score 39 desirably promotes consistent, high-speed manufacture of the present tamper-indicating closure, and desirably precludes any propagation of upper vertical score 36, which could otherwise undesirably act to form a strength-inhibiting crack or the like in the plastic closure.

In order to avoid premature failure of residual portion 38 attendant to the wedge-like cutting action of the blades which form vertical scores 36, another score is formed substantially simultaneously at a closely circumferentially spaced location on the band 22. In practice, the formation of a vertically extending stabilizing score 40 is preferred. Stabilizing score 40 is preferably configured to be generally vertically aligned with, and to generally span residual portion 38. Further, formation of stabilizing score 40 substantially simultaneously with, but preferably just before, formation of scores 36 results in very consistent and accurate formation of fracturable residual portion 38.

The present scoring arrangement for pilfer band 22 is preferably configured in accordance with the following parameters. The dimension between stabilizing score 40 and circumferential score 28 is sufficiently greater than the spacing between upper score 36 and score 28 to assure that the band always fails at the unscored residual region between upper score 36 and score 28. The dimension between the lower end of stabilizing score 40 and the edge of band 22 is preferably sufficiently large to avoid tearing between the score 40 and the edge of the band by the scoring blade which forms score 40.

The length of stabilizing score 40 is sufficient to support and stabilize the non-scored fracturable portion 38 as it is formed, with the portion 38 and the further residual between upper score 36 and score 28 being the only areas affecting closure removal. In current practice, spacing between stabilizing score 40 and residual portion 38 on the order of 0.030–0.040 inches has provided the desired stabilizing effect. Essentially, the desired goal of the present invention is to provide a minimal non-scored fracturable area for ease of closure removal, while still providing an closure which is sufficiently strong to avoid failure attendant to high-speed closure printing and container capping.

From the foregoing, it will be observed that numerous modifications and variations can be effected without deparing from the true spirit and scope of the novel concept of the present invention. Accordingly, no limitation with respect to the specific embodiment of the invention disclosed herein is intended or should be inferred. Rather, it is intended to cover all such modifications and variations of the invention as fall within the scope of the appended claims.

What is claimed is:

1. A tamper-indicating closure, comprising:

a plastic cap having a top wall portion and a depending annular skirt portion; and an annular pilfer band depending from said skirt portion and being partially detachably connected thereto, and distinguished therefrom by circumferential, horizontal score means having spaced apart ends between which is provided a connector portion for integrally joining said pilfer band with said annular skirt portion, said pilfer band including a fracturable portion provided by vertical score means positioned beneath said horizontal score means, said pilfer band further including means for substantially preventing propagation of said vertical score means, said propagation preventing means comprising further score means formed in said pilfer band in substantially intersecting relationship with said vertical score means in closely spaced relationship below said circumferential horizontal score means to substantially prevent propagation of said vertical score means.

2. A tamper-indicating closure in according with claim 1, wherein said further score means extends horizontally and is thereby perpendicular to said vertical score means.

3. A tamper-indicating closure in accordance with claim 1, wherein said further score means substantially intersects said vertical score means at the uppermost extent of said vertical score means.

4. A tamper-indicating closure in accordance with claim 3, wherein said vertical score means comprises a pair of vertically spaced, upper and lower vertical scores between which is provided said fracturable portion.

* * * * *